US005760801A

United States Patent [19]

Jackson et al.

[11] Patent Number: 5,760,801

[45] Date of Patent: Jun. 2, 1998

[54] INK JET PRINTER HAVING PRINT HEAD AND MAINTENANCE SYSTEM ALIGNMENT

[75] Inventors: Jerome E. Jackson, Newtown; Richard A. Malin, Westport; Edilberto I. Salazar, Brookfield, all of Conn.

[73] Assignee: Pitney Bowes Inc., Stamford, Conn.

[21] Appl. No.: 786,383

[22] Filed: Jan. 16, 1997

[51] Int. Cl.[6] ..... B41J 2/165

[52] U.S. Cl. ..... 347/29; 347/32

[58] Field of Search ..... 347/29, 33, 32, 347/22; 400/702, 701; 101/483, 485, 486, 423, 425

[56] References Cited

U.S. PATENT DOCUMENTS 4,459,050 7/1984 Goldberg et al. ..... 400/121

5,467,709 11/1995 Salomon ..... 101/93

*Primary Examiner*—N. Le

*Assistant Examiner*—Thin H. Nguyen

*Attorney, Agent, or Firm*—Angelo N. Chaclas; Melvin J. Scolnick

[57] ABSTRACT

A method comprising the step(s) of: positioning a print head and a maintenance head of an ink jet printer into proper mating relationship; driving the print head to a hard stop; measuring an indicator of the distance from the proper mating relationship position to the print head hard stop; storing the print head distance indicator in a memory; driving the maintenance head to a hard stop; measuring an indicator of the distance from the proper mating relationship position to the maintenance head hard stop; storing the maintenance head distance indicator in the memory; using the print head distance indicator to repeatably return the print head to the proper mating relationship position; and using the maintenance head distance indicator to repeatably return the maintenance head to the proper mating relationship position.

7 Claims, 2 Drawing Sheets

INK JET PRINTER HAVING PRINT HEAD AND MAINTENANCE SYSTEM ALIGNMENT

CROSS REFERENCE TO RELATED APPLICATIONS

This application is related to patent application Ser. No. 08/710,795 filed on Sep. 23, 1996 and entitled INKJET PRINTHEAD MAINTENANCE SYSTEM (E-553).

BACKGROUND OF THE INVENTION

The present invention generally relates to ink jet printers having an ink jet print head and a maintenance system. More particularly, the present invention relates to aligning the print head and the maintenance system.

Print heads are used in many applications today, and a preferred print head is an ink jet printer. Such printers spray small drops of ink on paper and typically travel along an axis of transport. When ink jet printers are not in use they are moved to a maintenance station where a cleaning and maintenance procedure is effected which includes wiping, priming, spitting and capping. Typically, the maintenance system is spaced in axial alignment with the path of travel of the print head. In this manner, the axis of transport of the print head must necessarily extend beyond the range where printing is to occur.

In some applications of ink jet printers, such as in a postage meter or mailing machine, there is not enough room along the axis of transport to dock the print head. Additionally, moving the print head along more than one axis to accommodate the maintenance system would be excessively complex. Thus, use of an ink jet printer having the print head and maintenance system in axial alignment meter is difficult to effect in some applications.

In U.S. patent application Ser. No. 08/710,795, filed on Sep. 23, 1996, entitled INKJET PRINTHEAD MAINTENANCE SYSTEM (E-553) and assigned to the assignee of the present invention, there is described an apparatus and a method for cleaning and maintaining the ink jet print head with a maintenance head which seeks to resolves the problems discussed above. The apparatus includes: an ink jet print head translatable in a first plane; a device for translating the print head to a cleaning station; an ink jet maintenance head translatable in a second plane, wherein the first plane is not parallel to the second plane; and a device for translating the maintenance head in at least two directions in the second plane to engage the print head at the cleaning station.

Although this system generally works well, there are difficulties which respect to aligning the print head in the first plane and aligning the maintenance head in the second plane accurately so that the print head and the maintenance head are in proper mating relationship. Proper mating relationship is important to ensure that: (1) the print head is not exposed to ambient air which tends to cause excessive evaporation of ink resulting in clogging of the print head; and (2) ink is not sprayed on other components of the ink jet printer during a maintenance cycle. Generally, the difficulties associated with aligning both the print head and the maintenance head are associated with a number of factors, such as: manufacturing tolerances and precision positioning in two separate directions.

Accordingly, the present invention provides an ink jet printer having print head and maintenance system alignment to ensure that the print head and the maintenance head achieve a proper mating relationship.

SUMMARY OF THE INVENTION

The present invention provides a method for aligning the print head and the maintenance head. Conventionally, this invention may be incorporated into a postage meter or other ink jet printer.

In accordance with the present invention a method is provided which comprises the step(s) of: positioning a print head and a maintenance head of an ink jet printer into proper mating relationship; driving the print head to a hard stop; measuring an indicator of the distance from the proper mating relationship position to the print head hard stop; storing the print head distance indicator in a memory; driving the maintenance head to a hard stop; measuring an indicator of the distance from the proper mating relationship position to the maintenance head hard stop; storing the maintenance head distance indicator in the memory; using the print head distance indicator to repeatably return the print head to the proper mating relationship position; and using the maintenance head distance indicator to repeatably return the maintenance head to the proper mating relationship position.

Therefore, it is now apparent that the present invention substantially overcomes the disadvantages associated with aligning print heads and maintenance heads. Additional advantages of the invention will be set forth in the description which follows, and in part will be obvious from the description, or may be learned by practice of the invention.

DETAILED DESCRIPTION OF THE PREFERRED EMBODIMENT

Figure 1:
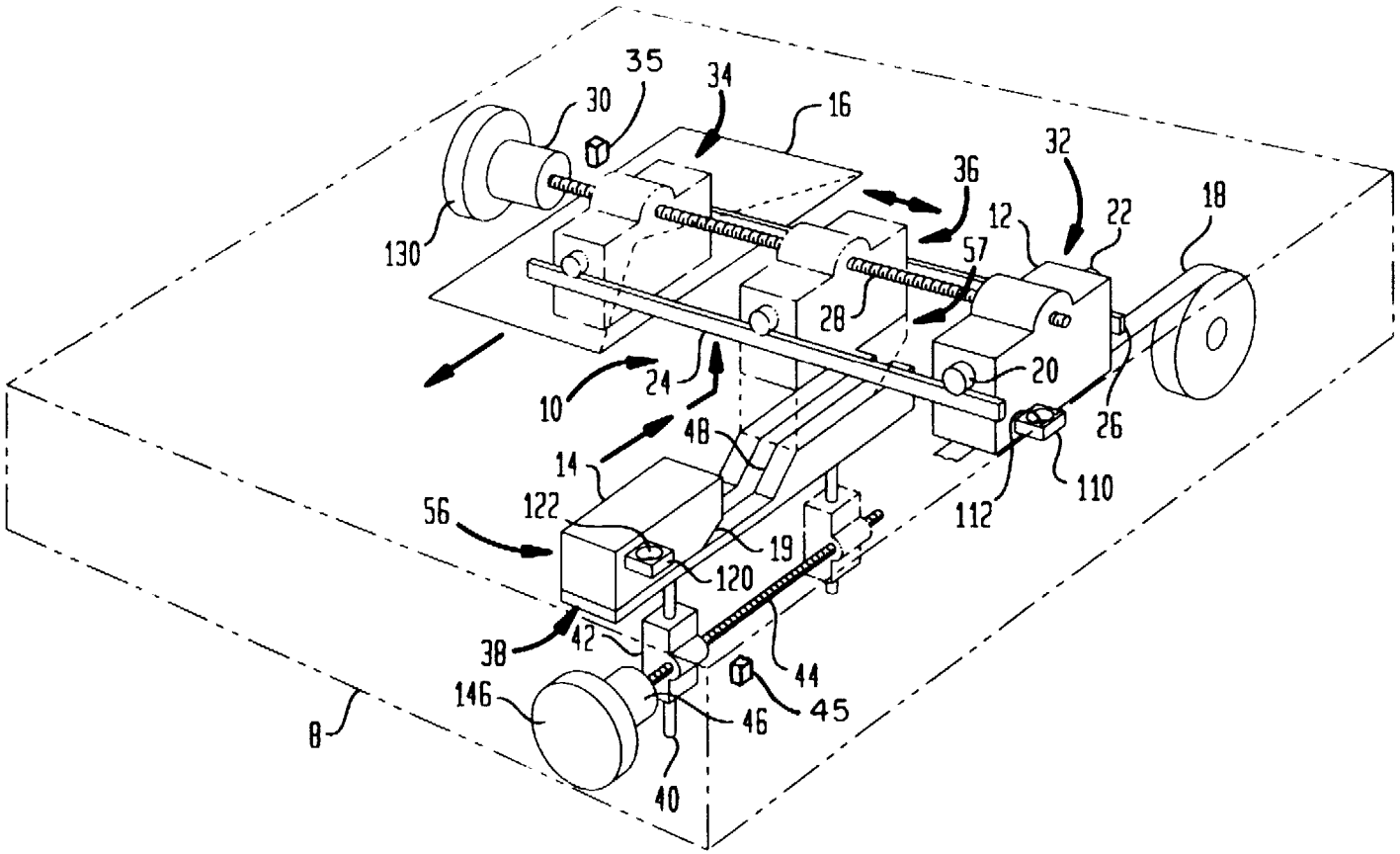
FIG. 1 is a schematic, perspective view of a postage meter having an ink jet printer showing the print head and maintenance head in accordance with the instant invention.

In describing the preferred embodiment of the instant invention, reference is made to the drawings, wherein there is seen in FIG. 1 a postage meter 8 having an ink jet printing system generally designated 10 which includes an ink jet print head 12, an ink jet maintenance head 14 for servicing and cleaning the print head 12 and suitable framework (not shown) for supporting the various components of the ink jet printing system 10. The print head 12 is used for printing a postage indicia on an envelope 16, which travels in the direction indicated by the arrow, and also on tape 18 passing therebelow in a path parallel to the path of the envelope 16 as explained in further detail hereinbelow. The print head 12 includes a pair of rollers 20 and 22 which ride on a pair of rails 24 and 26 respectively. A lead screw 28 is driven by a drive motor 30 and threadingly engages the top of the print head 12 in order to translate the print head 12 back and forth along the rails 24 and 26. A conventional encoder system 130 is operatively connected to the drive motor 30 for providing signals indicative of the position of the print head 12 along the lead screw 28, such as a light source (not shown), a light detector (not shown) and a vane (not shown) fixably mounted to the shaft of the motor 30 and operatively located between the light source and the light detector to alternatively block and unblock the light source.

The print head 12 can be stopped in one of three positions. FIG. 1 shows the print head 12 stopped at station 1, indicated by arrow 32, at which the print head 12 can print on the tape 18 in conventional manner. The print head 12 can also be stopped at station 2, indicated by the arrow 34, at which the print head 12 can print on the envelope 16 in conventional manner. The home or resting position of the print head 12 is at station 3 indicated by the arrow 36.

The print head 12 further includes an alignment tab 110 having an alignment hole 112 located therethrough. The alignment tab 110 is located on a vertical wall of the print head 12 near the bottom of the print head 12.

Figure 2:
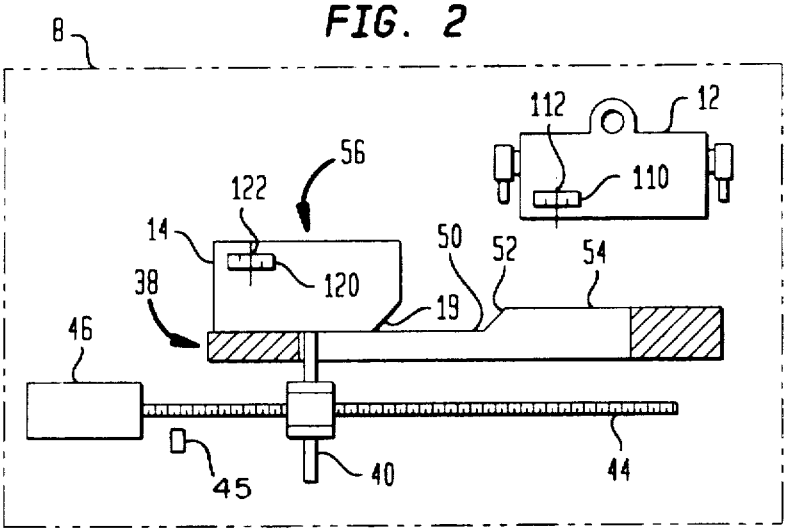
FIG. 2 is a schematic, side, elevational view of the maintenance head in its home position.
Figure 3:
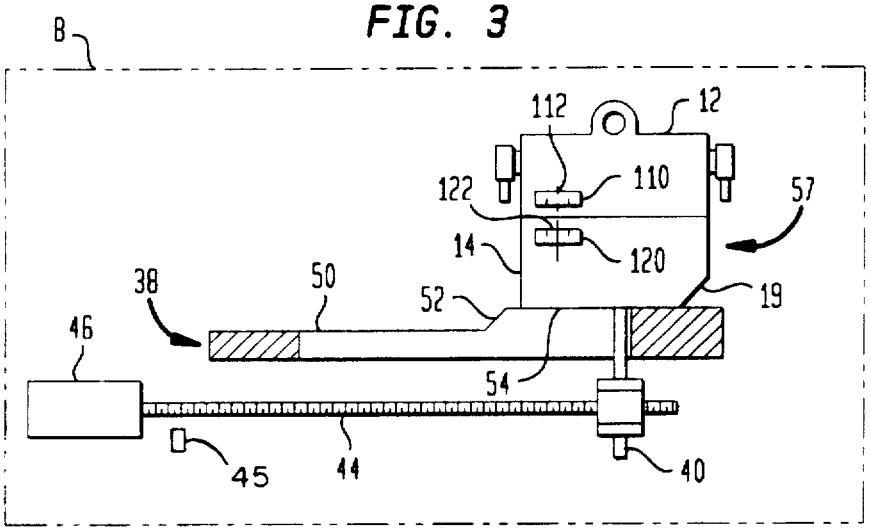
FIG. 3 is similar to FIG. 2 but shows the maintenance head in the capping position adjacent the print head.
Figure 4:
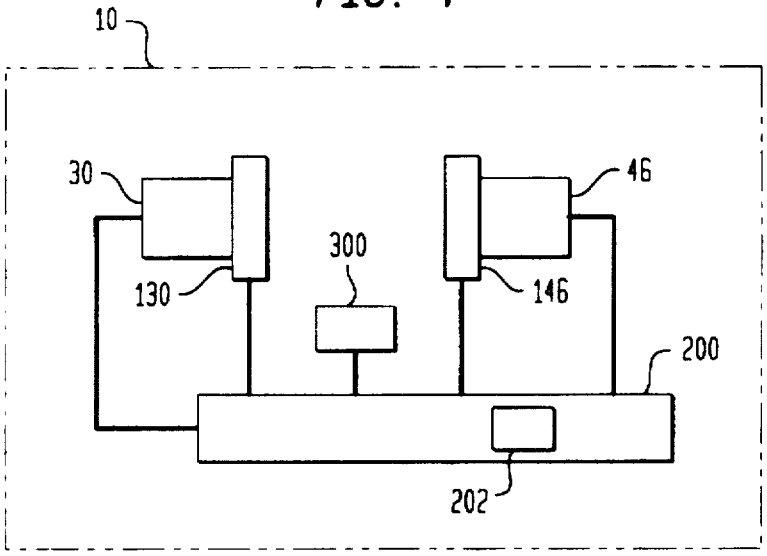
FIG. 4 is a block diagram of the ink jet printer including a control system.

The maintenance head 14 has a camming surface 19 which sits on a track 38 and is translatable along the track 38 by means of a pin 40 which engages an aperture (not shown) in the maintenance head 14 The track 38 is vertically aligned with the print head station 3. The pin 40 is seated in a block 42 which threadingly engages a lead screw 44 which in turn is driven by a drive motor 46. The track 38 includes a slot 48 in which the pin 40 is translated. As best seen in FIGS. 2 and 3, the track 38 includes a horizontal path or section 50, an angled, cam section 52, and a second, horizontal section 54 at the end thereof. The cam section 52 is shown angled at a diagonal, but other angles or shapes could be employed. In FIGS. 1 and 2, the maintenance head 14 is shown at its home or resting position which is station 4 indicated by the arrow 56. The maintenance head 14 is situated at station 4 whenever the print head 12 is being used to print the envelopes 16 or the tape 18.

The maintenance head 14 further includes an alignment tab 120 having an alignment hole 122 located therethrough. The alignment tab 120 is located on a vertical wall of the maintenance head 14 near the top of the maintenance head 14.

Additionally, a conventional encoder system 146 is operatively connected to the drive motor 46 for providing signals indicative of the position of the maintenance head 12 along the lead screw 44.

Whenever the print head 12 is not being used to print envelopes 16 or tape 18, the print head 12 is translated by the lead screw 28 to the position of station 3 and remains stationary at station 3. Whenever the print head 12 is stationary at station 3, the ink jet printing system 10 is programmed to move the maintenance head 14 to station 5 indicated by the arrow 57 into a docked position which is in mating relationship with the print head 12, as shown in FIG. 3, i.e. the maintenance head 14 is moved below the print head 12.

The movement of the maintenance head 14 along the track 38 to the station 5 will now be described. The maintenance head 14 moves in a single, vertical plane which is aligned with the print head home station 3. The initial movement of the maintenance head 14 along the track 38 is from left to right on the first horizontal path 50. Continued translation of the pin 40 by the drive motor 46 causes the maintenance head 14 to approach the cam section 52, at which point the camming surface 19 of the maintenance head 14 engages the cam section 52 to thereby lift the maintenance head 14 as it is being translated from left to right. When the camming surface 19 has finished traversing the cam section 52, the maintenance head 14 is elevated and continues to move from left to right along the second horizontal track section 54 to the cleaning position seen in FIG. 3. Thus, the maintenance head 14 experiences lateral and vertical movement in being moved from its home position at station 4 to its cleaning position at station 5 where the top surface of the maintenance head 14 engages the bottom surface of the print head 12. The lateral movement takes place along the horizontal track sections 50 and 54, and both lateral and vertical movement takes place along the cam section 52. The movement along the horizontal track sections 50 and 54 comprises movement in one direction and the movement along the cam section 52 comprises movement in a second direction. Thus, there is movement by the maintenance head 14 in two directions. Clearly, the two directions of movement will comprise elements of both lateral and vertical movement. Since both lateral and vertical movement of the maintenance head 14 are required to move it into its cleaning position at station 5, movements other than what is shown in FIGS. 1–3 could be employed, e.g. one direction of movement could be purely horizontal and another direction of movement could be purely vertical.

When the maintenance head 14 moves past the print head 12 located thereabove, the wiper (not shown) of the maintenance head 14 wipes the nozzles (not shown) on the bottom of the print head 12 in conventional manner. The capping device (not shown) of the maintenance head 14 hermetically seals the nozzles of the print head 12 when the maintenance head 14 is stopped from further translation along the track 38, and a vacuum can be applied to the maintenance head 14 to remove ink from the nozzles. Additionally, the nozzles of the print head 12 can be fired into a spittoon (not shown) or capping device of the maintenance head.

Referring to FIGS. 1, 2, 3 and 4, the ink jet printing system 10 further includes a control system 200 having a memory 202. The control system 200 is in operative communication with the encoder systems 130 and 146 and the motors 30 and 46 for receiving input signals from the encoder systems 130 and 146, respectively, and outputting control signals to the motors 30 and 43, respectively, for positioning the print head 12 and the maintenance head 14 along their respective lead screws 28 and 44. The control system 200 is further in communication with any suitable interface 300, such as a keyboard and LCD or CRT display, which allows the operator to receive information from and provide inputs to the postage meter 8. The control system 200 may include any suitable combination of hardware, software and processors.

With the structure of the ink jet printing system 10 described as above, attention will now turn to the operational characteristics of aligning the print head 12, while in the home position at station 3, with the maintenance head 14, while in the cleaning position at station 5.

Before the postage meter 8 is completely installed at a user location, an alignment calibration routine is performed. The alignment calibration routine may take place during the manufacturing process or during installation at the user location and is used to establish station 3 for the print head 12 and station 5 for the maintenance head 14 so that during normal operation the print head 12 and the maintenance head 14 are in proper mating relationship.

To begin the alignment calibration routine the print head 12 and the maintenance head 14 are brought into proper mating relationship. This is accomplished by repositioning the print head 12 and the maintenance head 14 along their respective lead screws 28 and 44 until the capping device properly covers the nozzles of the print head 12. To assist in this step, the alignment tabs 110 and 120 are provided. Since the alignment tabs 110 and 120 are manufactured with close tolerance to the remaining features of the print head 12 and the maintenance head 14, respectively, they can be used to assist in properly aligning the print head 12 and the maintenance head 14 by inserting a pin (not shown) through the alignment holes 112 and 122.

Once the proper mating relationship has been established, the print head 12 and the maintenance head 14 are driven along their respective lead screws 28 and 44 until they each reach a fixed hard stop 35 and 45 respectively on one end of each lead screw 28 and 44. The fixed hard stops 35 and 45, respectively provide a known reference location from which the distance to the station 3 and station 5 can be measured. The controller 200 counts the number of encoder pulses from the proper mating relationship position to each respective hard stop 35 and 45 for both the print head 12 and the maintenance head 14. These respective values, print head encoder pulse count (station 3 count) and maintenance head encoder pulse count (station 5 count), are then stored in memory 202 for later use.

It should now be apparent that this routine establishes a reference point for the print head 12 from its hard stop 35 which can be used in repeating accurately the proper position of the print head 12 in station 3. Similarly, this routine establishes a reference point for the maintenance head 14 from its hard stop 45 which can be used in repeating accurately the proper position of the maintenance head 14 in station 5. Thus, a proper mating relationship can be repeatably achieved. Therefore, any tolerancing problems between different postage meters 8 will be accounted for since the encoder pulse counts are unique to each postage meter 8.

The print head encoder pulse count and the maintenance head encoder pulse count are preferably stored in a non-volatile type memory 202. In this manner, these counts will not be lost due to power loss in the postage meter 8.

Those skilled in the art will recognize that the hard stops 35 and 45, respectively, may merely be one the end of the lead screw 28 and 44, respectively. In which case the respective encoder pulses are counted until the motors 30 and 46, respectively, stall. On the other hand, a mechanical switch or optical sensor could be employed to signal the controller 200 to stop counting encoder pulses.

When the postage meter 8 is turned on the controller 200 instructs the ink jet printing system 10 to print on the envelope 16, then the print head is driven to station 2 while the maintenance head 14 is driven to station 4. After completing printing, the controller 200 returns the print head 12 to station 3 and the maintenance head 14 to station 5 using the print head encoder pulse count and the maintenance head encoder pulse count, respectively. At predetermined intervals and/or upon the occurrence of a particular event, the controller 200 drives the print head 12 and the maintenance head 14 to their respective hard stops so as to prevent "drift" or "wander" of the system. Thus, the print head encoder pulse count and the maintenance head encoder pulse count which are stored in memory 202 continue to serve as accurate indicators of reference points where a proper mating relationship occurs.

Those skilled in the art will further recognize that if stepper motors are utilized, then it is possible to count motor pulses instead of encoder pulses. Also, it is preferable that the print head encoder pulse count and the maintenance head encoder pulse count are stored in a non-volatile type memory 202. In this manner, these counts will not be lost due to power loss in the postage meter 8.

The ink jet printing system 10 described hereinabove is arranged in such a way that it occupies a minimum of space and thus can be used in many applications which otherwise lack sufficient space for an ink jet printer. A postage meter is just one example of the many applications for which the foregoing ink jet printing system 10 is suitable.

Also stored in the memory 202 are counts from the print head hard stop to station 1 and station 2, respectively. Unlike the count for station 3 which is derived empirically as discussed above, the station 1 count and the station 2 count are set to nominal default values without measurement since these counts do not have the same accuracy requirements as the station 3 count discussed above.

By using the interface 300, the operator is allowed to independently manipulate the station 1 and station 2 counts so as to reposition the postage indicia on the envelope 16 or the tape 18. In this manner, the postage indicia can be adjusted along the envelope 16 or tape 18 in a direction which is transverse to the path of travel. Prior art systems only allow adjustment of the postage indicia in a direction parallel to the path of travel. Any suitable combination of hardware and software could serve as the interface 300 and controller 200. For example, the operator may be presented with a visual indication on the LCD of the position of the postage indicia on the envelope 16. Then, using up arrow and down arrow keys or other conventional input device, the operator may reposition the postage indicia where each depression of a respective arrow key either substracts or adds a predetermined incremental number of counts to the station 2 count. The same technique could be employed to adjust the station 1 count. To accomodate this, the interface 300 provides a menu system where the operator can select whether to adjust the position of the postage indicia on the envelope 16 or the tape 18.

While the present invention has been disclosed and described with reference to a single embodiment thereof, it will be apparent, as noted above that variations and modifications may be made therein. For example, those skilled in the art will recognize a wide variety of structures which could be substituted for the alignment tabs 110 and 120 would assist in aligning the print head 12 with the maintenance head 14, such as a pin on the print head 12 and a receiving slot on the maintenance head 14. It is, thus, intended in the following claims to cover each variation and modification that falls within the true spirit and scope of the present invention as defined by the claims.

What is claimed is:

1. A method of establishing a proper mating relationship between a print head and a maintenance head of an ink jet printer, the method comprising the step(s) of:

positioning the print head and the maintenance head of the ink jet printer into a proper mating position;

driving the print head to a hard stop;

obtaining an indicator of a distance from the proper mating position to the print head hard stop;

storing the print head distance indicator in a memory; and using the print head distance indicator to repeatably return the print head to the proper mating position.

2. The method of claim 1 comprising the step(s) of:

driving the maintenance head to a hard stop;

obtaining an indicator of a distance from the proper mating relationship position to the maintenance head hard stop; and storing the maintenance head distance indicator in the memory.

3. The method of claim 2 comprising the step(s) of:

using the maintenance head distance indicator to repeatably return the maintenance head to the proper mating relationship position.

4. The method of claim 1 comprising the step(s) of:

storing an indicator of a distance from the proper mating position to a print position for the print head in the memory; and using the print position distance indicator to drive the print head to the print position.

5. The method of claim 4 comprising the step(s) of:

providing a user interface for allowing an operator to adjust the print position to a new print position; and storing an indicator of the new print position in the memory for use in subsequently driving the print head to the new print position.

6. The method of claim 3 comprising the step(s) of:

storing an indicator of a distance from the proper mating position to a print position for the print head in the memory; and using the print position distance indicator to drive the print head to the print position.

7. The method of claim 6 comprising the step(s) of:

providing a user interface for allowing an operator to adjust the print position to a new print position; and storing an indicator of the new print position in the memory for use in subsequently driving the print head to the new print position.

* * * * *